US009259934B1

(12) United States Patent
Kobayashi

(10) Patent No.: US 9,259,934 B1
(45) Date of Patent: Feb. 16, 2016

(54) PRINTER

(71) Applicant: BROTHER KOGYO KABUSHIKI KAISHA, Nagoya-shi, Aichi-ken (JP)

(72) Inventor: Haruo Kobayashi, Ichinomiya (JP)

(73) Assignee: BROTHER KOGYO KABUSHIKI KAISHA, Nagoya-Shi (JP)

( * ) Notice: Subject to any disclaimer, the term of this patent is extended or adjusted under 35 U.S.C. 154(b) by 0 days.

(21) Appl. No.: 14/831,166

(22) Filed: Aug. 20, 2015

(30) Foreign Application Priority Data

Aug. 22, 2014 (JP) ..... 2014-169366

(51) Int. Cl.
*B41J 2/165* (2006.01)

(52) U.S. Cl.
CPC ..... *B41J 2/16544* (2013.01)

(58) Field of Classification Search
CPC ..... B41J 2/16538; B41J 2/16544; B41J 2/165
See application file for complete search history.

(56) References Cited

U.S. PATENT DOCUMENTS 6,467,873 B1 * 10/2002 Toba ..... B41J 2/16538 347/33

FOREIGN PATENT DOCUMENTS

JP 2001-180013 A 7/2001

* cited by examiner

*Primary Examiner* — Sarah Al Hashimi
(74) *Attorney, Agent, or Firm* — Fox Rothschild LLP

(57) ABSTRACT

A printer includes a head portion, a wiper, a wiper support portion, an urging portion, an inclined portion, an engagement portion, and a guide wall portion. The head portion includes a nozzle surface including a nozzle configured to eject liquid. The nozzle surface extends in a first direction and an orthogonal direction. The wiper is configured to contact with the nozzle surface. The wiper support portion supports the wiper. The urging portion is configured to urge the wiper in a second direction. The first protrusion portion is provided on the wiper support portion. The inclined portion is configured to move the wiper between a contact position and a separated position in accordance with movement of the inclined portion. The engagement portion is configured to engage with the first protrusion portion. The guide wall portion is configured to guide the movement of the wiper.

7 Claims, 14 Drawing Sheets

PRINTER

CROSS-REFERENCE TO RELATED APPLICATION

This application claims priority to Japanese Patent Application No. 2014-169366 filed Aug. 22, 2014, the content of which is hereby incorporated herein by reference.

BACKGROUND

The present disclosure relates to a printer including a wiper configured to remove ink attached to a nozzle.

A printer is known that includes a wiper configured to remove liquid, such as ink, from a nozzle surface including a nozzle configured to eject the liquid. For example, a known inkjet type recording device includes a carriage, a wiper, and an ink removing member. The carriage includes a recording head including a nozzle surface. In accordance with movement of the carriage, the wiper slides in contact with the nozzle surface of the recording head such that the wiper removes ink attached to the nozzle surface. The ink removing member is configured to remove ink attached to the wiper.

SUMMARY

Embodiments provide a printer that includes a head portion, a wiper, a wiper support portion, an urging portion, a first protrusion portion, an inclined portion, an engagement portion, and a guide wall portion. The head portion includes a nozzle surface. The nozzle surface includes a nozzle configured to eject liquid. The nozzle surface extends in a first direction and an orthogonal direction. The orthogonal direction is a direction orthogonal to the first direction. The head portion is configured to move in the orthogonal direction. The wiper is configured to contact with the nozzle surface. A first side of the wiper is configured to be opposed to the nozzle surface. The wiper support portion supports the wiper. A first side of the wiper support portion is provided on a second side of the wiper. The second side of the wiper is an opposite side to the first side of the wiper. The urging portion is configured to urge the wiper in a second direction. The second direction is a direction from the wiper toward the wiper support portion. The second direction is orthogonal to the nozzle surface. The first protrusion portion is provided on the wiper support portion. The inclined portion is configured to move in the orthogonal direction. The inclined portion is positioned on a second side of the wiper support portion. The second side of the wiper support portion is an opposite side to the first side of the wiper support portion in the second direction. The inclined portion is inclined in the second direction with respect to the orthogonal direction. The inclined portion is configured to move the wiper between a contact position and a separated position in accordance with movement of the inclined portion. The wiper is configured to contact with the nozzle surface in the contact position. The wiper is configured to be separated from the nozzle surface in the separated position. The inclined portion is provided with an opening portion on an end portion on a side, of the inclined portion, toward the second direction. The engagement portion is provided on the inclined portion. The engagement portion extends along the inclined portion. The engagement portion is configured to engage with the first protrusion portion. The first protrusion portion is configured to slide with respect to the engagement portion when the wiper is moved between the contact position and the separated position. The first protrusion portion is configured to be attached to and detached from the engagement portion via the opening portion. The guide wall portion is configured to guide the movement of the wiper between the contact position and the separated position.

BRIEF DESCRIPTION OF THE DRAWINGS

Embodiments will be described below in detail with reference to the accompanying drawings in which.

DETAILED DESCRIPTION

An embodiment will be explained with reference to the drawings. A configuration of a printer 1 will be explained with reference to FIG. 1 to FIG. 11. The upper side, the down side, the lower left side, the upper fight side, the lower right side, and the upper left side in FIG. 1 respectively correspond to an upper side, a down side, a front side, a rear side, a right side, and a left side of the printer 1.

Figure 1:
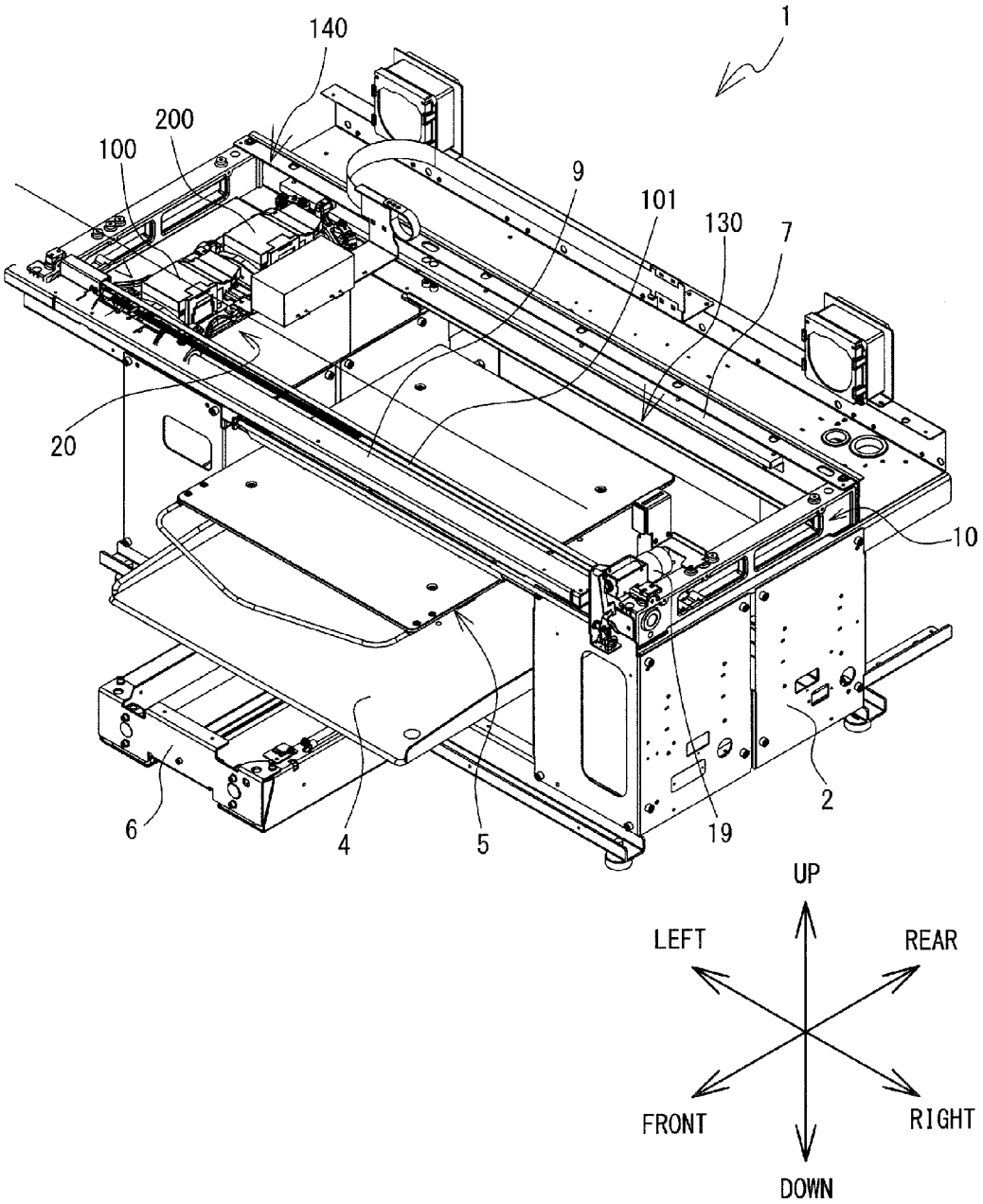
FIG. 1 is a perspective view of a printer.

As shown in FIG. 1, the printer 1 is an inkjet printer that is configured to perform printing on a fabric (not shown in the drawings) such as a T-shirt, which is a print medium, by ejecting liquid ink. Paper or the like may be used as the print medium. In the present embodiment, the printer 1 can perform printing of a color image onto the print medium, by downwardly ejecting five different types (white (W), black (K), yellow (Y), cyan (C), and magenta (M)) of the ink. The black, cyan, yellow, and magenta inks are collectively referred to as color inks.

The printer 1 includes a housing 2, a platen drive mechanism 6, a pair of guide rails (not shown in the drawings), a platen 5, a tray 4, a frame body 10, a guide shaft 9, a rail 7, a carriage 20, head units 100 and 200, a drive belt 101, and a drive motor 19.

The housing 2 is a substantially cuboid shape whose long sides extend in the left-right direction. An operation portion (not shown in the drawings) is provided on the front right side of the housing 2. The operation portion is used to cause the printer 1 to operate. The operation portion includes a display and operation buttons. The display is configured to display various information. The operation buttons may be operated when an operator inputs commands relating to various operations of the printer 1.

The frame body 10 has a substantially rectangular frame shape in a plan view. The frame body 10 is provided on an upper portion of the housing 2. The front side of the frame body 10 supports the guide shaft 9. The rear side of the frame body 10 supports the rail 7. The guide shaft 9 is a shaft member that includes a shaft-shaped portion that extends in the left-right direction on the inside of the frame body 10. The rail 7 is opposed to the guide shaft 9 and is a rod-shaped member that extends in the left-right direction.

Figure 3:
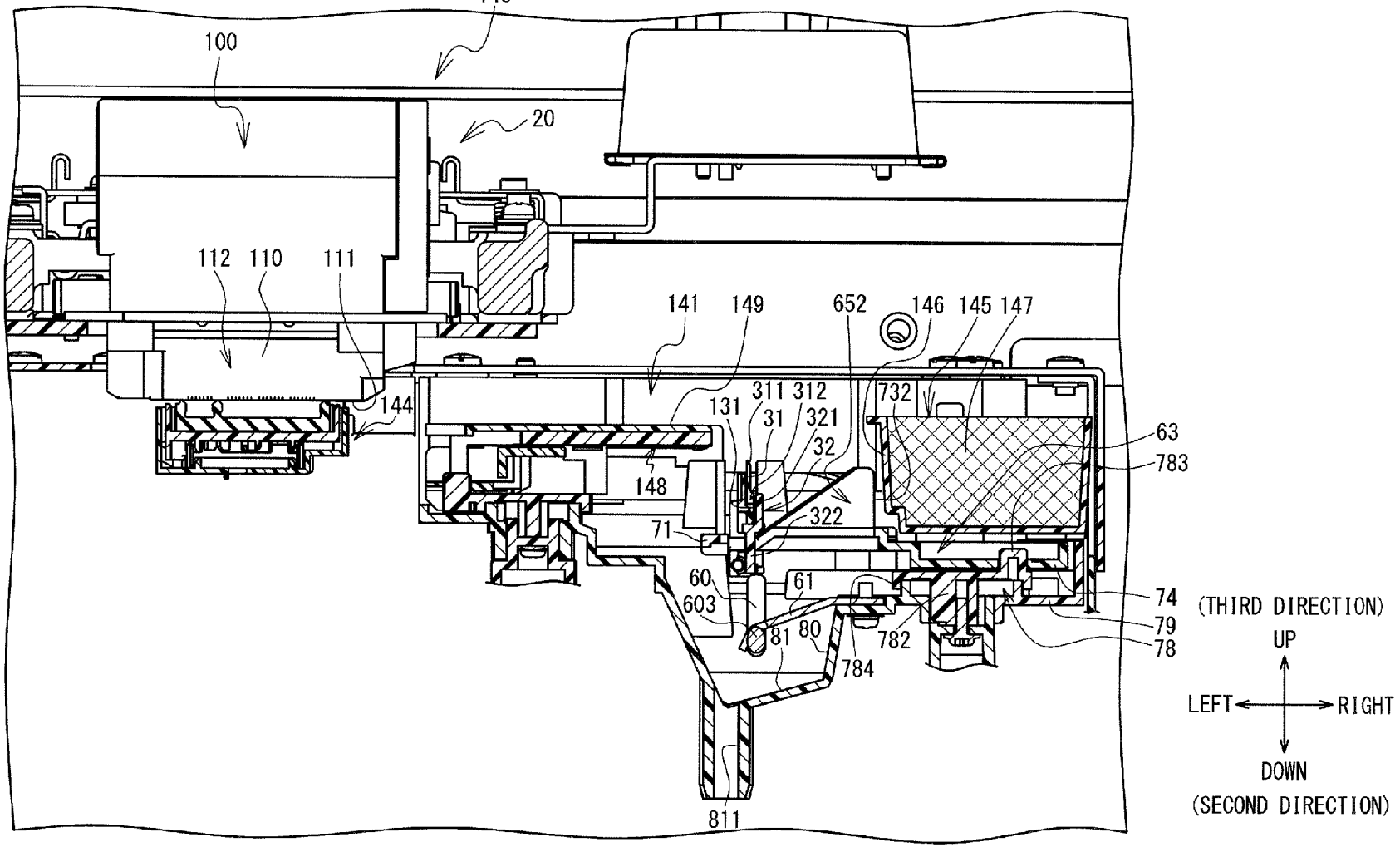
FIG. 3 is a cross-sectional view taken along a line A-A in the direction of arrows shown in FIG. 2 when a carriage has moved to the leftmost side and a wiper and a wiper support portion are in a separated position.

A carriage 20 is supported such that the carriage 20 can be conveyed in the left-right direction along the guide shaft 9. The head units 100 and 200 are mounted on the carriage 20 such that the head units 100 and 200 are arranged in the front-rear direction. The head unit 100 is positioned to the front of the head unit 200. As shown in FIG. 3, a head portion 110 is provided on a lower portion of each of the head units 100 and 200. A nozzle surface 111 is formed on the bottom surface of the head portion 110. The nozzle surface 111 is a flat surface. FIG. 3 shows the head portion 110 and the nozzle surface 111 of the head unit 100. The nozzle surface 111 includes a plurality of fine nozzles 112 that are configured to eject the ink downward. Hereinafter, the direction in which the nozzle surface extends is referred to as a first direction. When the printer 1 is placed on a level surface, the first direction is a horizontal direction, for example.

As shown in FIG. 1, a drive belt 101 is strip-shaped and is stretched along the left-right direction on the inside of the frame body 10. The drive belt 101 is made of flexible resin. The drive motor 19 is provided on the front right side on the inside of the frame body 10. The drive motor 19 is configured to rotate in the forward direction and the reverse direction. The drive motor 19 is coupled to the carriage 20 via the drive belt 101. When the drive motor 19 drives the drive belt 101, the carriage 20 is caused to reciprocate in the left-right direction along the guide shaft 9. In this manner, the head units 100 and 200 are caused to reciprocate in the left-right direction. Further, the head units 100 and 200 eject the ink toward a platen 5 disposed below the head units 100 and 200 such that the platen 5 is opposed to the head units 100 and 200. At this time, the platen 5 is conveyed in the front-rear direction by a platen drive mechanism 6. In this manner, printing is performed on a print medium supported by the platen 5.

The platen drive mechanism 6 includes the pair of guide rails (not shown in the drawings) and a platen support base (not shown in the drawings). The pair of guide rails extend in the front-rear direction on the inside of the platen drive mechanism 6. The pair of guide rails support the platen support base such that the platen support base can move in the front-rear direction. The upper portion of the platen support base supports the platen 5.

The tray 4 is provided below the platen 5. The tray 4 may receive a sleeve or the like of a T-shirt that is placed on the platen 5, and may thus protect the sleeve or the like from contacting with a component inside the housing 2.

By using, as a driving source, a motor (not shown in the drawings) provided on a rear end portion of the platen drive mechanism 6, the platen drive mechanism 6 moves the platen support base and the platen 5 along the pair of guide rails in the front-rear direction of the housing 2. The platen 5 conveys the print medium in the front-rear direction (a conveyance direction, a sub-scanning direction) and the ink is ejected from the head portion 110 that reciprocates in the left-right direction. Consequently, printing is performed on the print medium by the printer 1.

Figure 2:
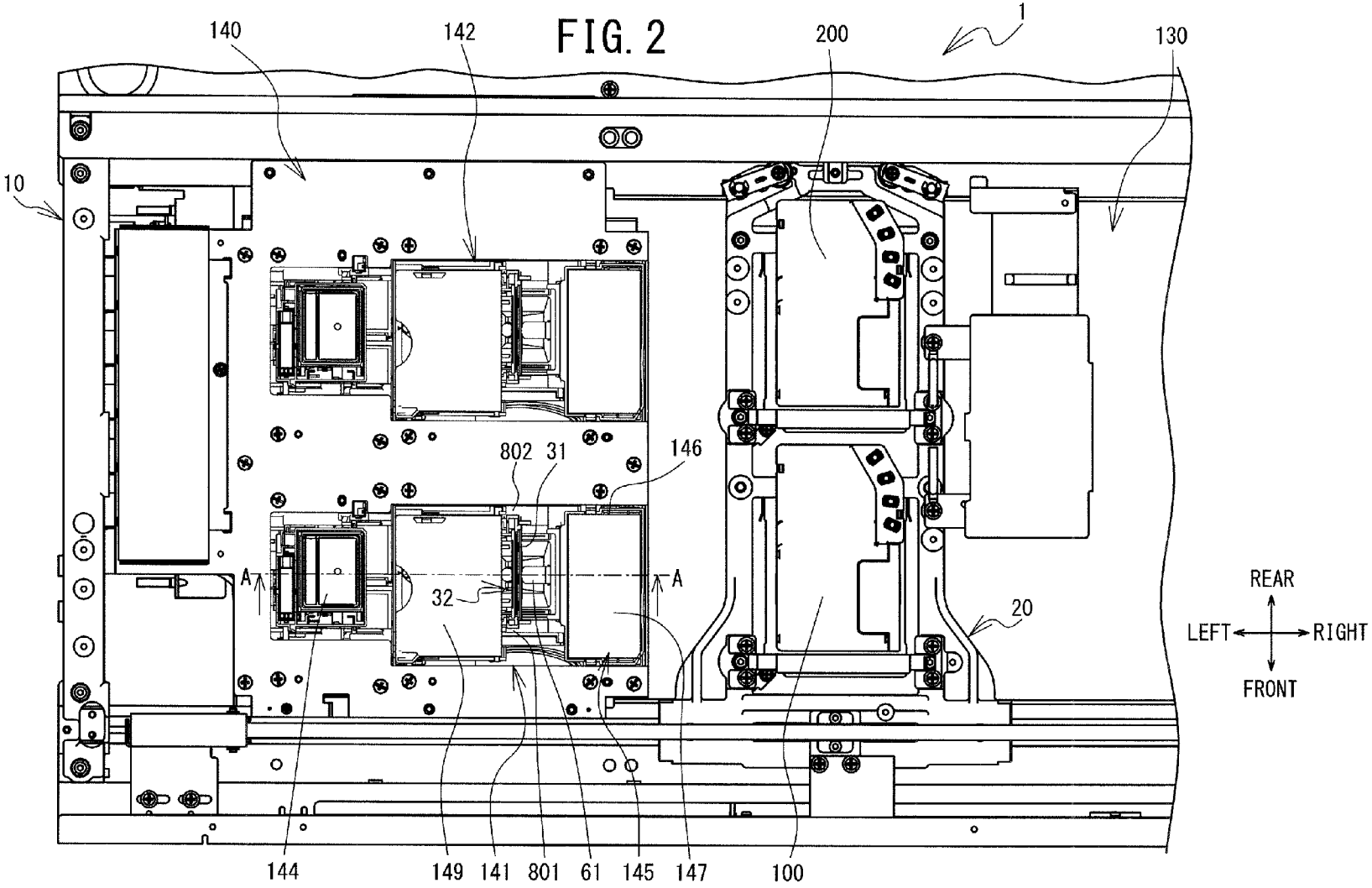
FIG. 2 is a plan view of the printer.

As shown in FIG. 1 and FIG. 2, in the present embodiment, the carriage 20 is disposed on the inside of the frame body 10. The head portion 110 can be moved in the first direction (the left-right direction, for example). For example, the head portion 110 can be moved in the left-right direction between a left end portion and a right end portion on the inside of the frame body 10. On a movement path of the head portion 110, an area in which printing is performed by the head portion 110 is referred to as a printing area 130. An area, on the movement path of the head portion 110, other than the printing area 130 is referred to as a non-printing area 140. The non-printing area 140 is an area of a left portion of the printer 1. The printing area 130 is an area from the right side of the non-printing area 140 to a right end portion of the printer 1. The platen 5, the tray 4, and the like are provided in the printing area 130.

In the present embodiment, various maintenance operations to secure the print quality are performed in the non-printing area 140. The maintenance operations include a flushing operation, an ink purge operation, a first wiping operation, and a second wiping operation, for example. The flushing operation is an operation in which, before the printing is performed on the print medium, the ink is ejected from the head portion 110 onto a flushing receiving portion 145 (refer to FIG. 2), which will be described below. As a result of performing the flushing operation, the ink can be ejected appropriately from the head portion 110 even immediately after printing is started. The ink purge operation is an operation in which the ink is drawn out from the nozzles 112 by a suction device (not shown in the drawings) connected to a nozzle cap 144 (refer to FIG. 2), in a state in which the nozzle surface 111 is covered by the nozzle cap 144. As a result of performing the ink purge operation, air bubbles entered inside the nozzles 112 can be discharged along with the ink. In this way, it is possible to reduce the possibility of the occurrence of ejection defects due to air bubbles.

Figure 10:
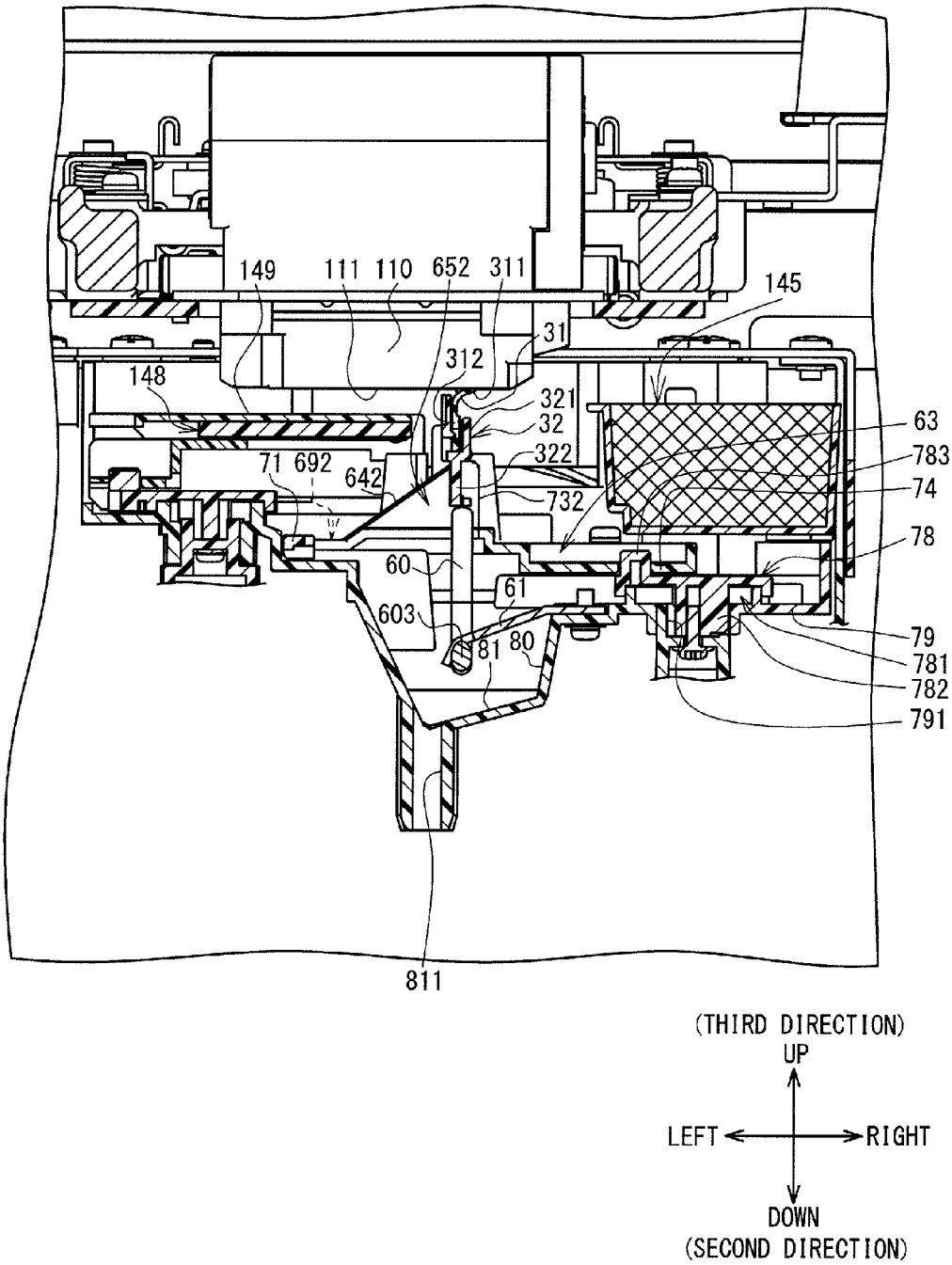
FIG. 10 is a cross-sectional view showing a state in which a head portion shown in FIG. 9 has moved to the right and the wiper is wiping ink from a nozzle surface.
Figure 11:
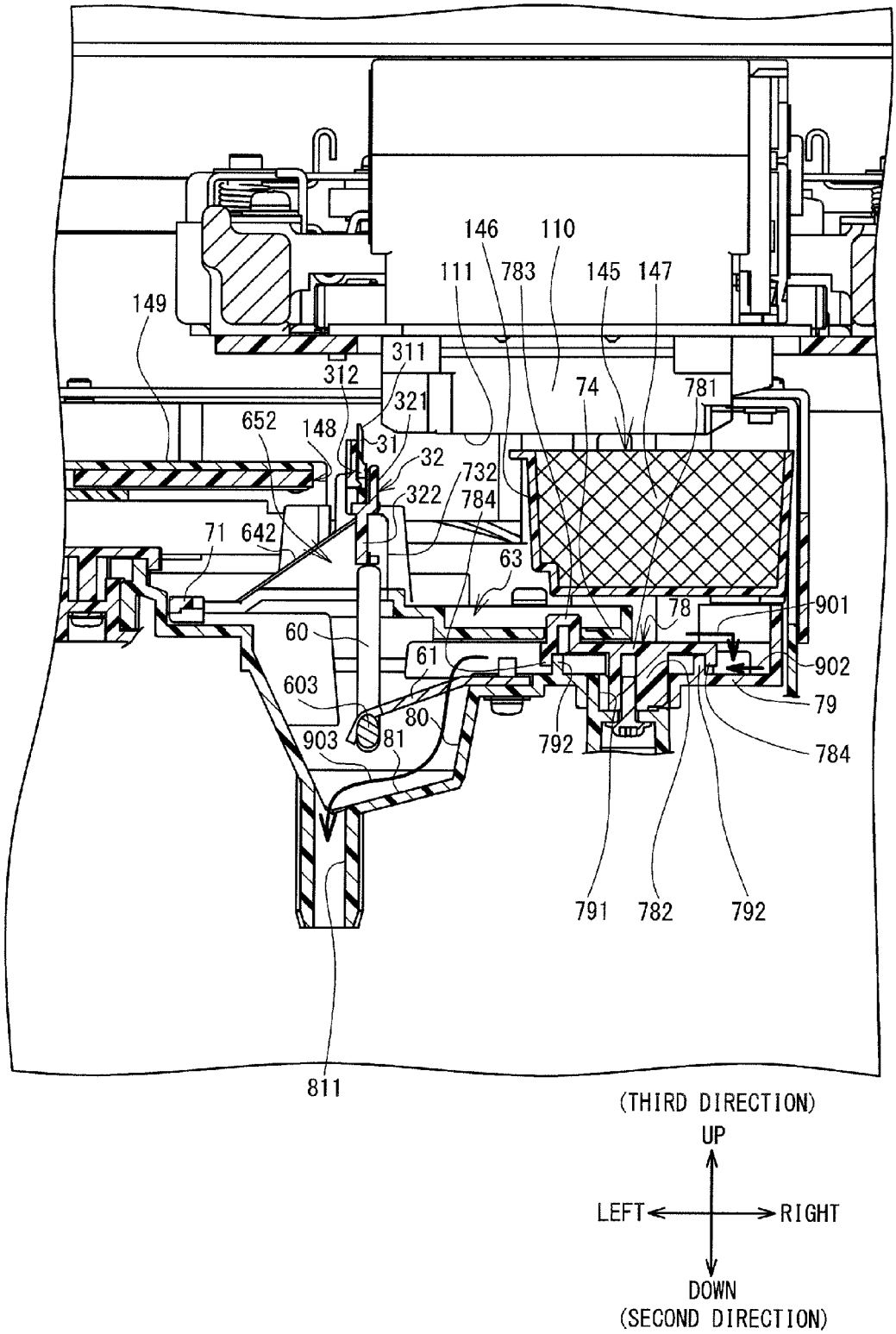
FIG. 11 is a cross-sectional view showing a state in which the head portion shown in FIG. 10 has moved further to the right.

The first wiping operation is an operation in which excessive ink that has remained on the surface of the nozzle surface 111 is wiped away by a wiper 31 (refer to FIG. 10). As a result of performing the first wiping operation, it is possible to reduce the possibility that the ink on the nozzle surface 111 is fixed. It is also possible to reduce the possibility that it becomes difficult to eject ink from the nozzle surface 111. The second wiping operation is an operation in which the ink attached to the wiper 31 is wiped away by an absorption member 148 (refer to FIG. 3). As a result of performing the second wiping operation, it is possible to reduce the possibility that the ink remaining on the wiper 31 attaches to the nozzle surface 111 when the next first wiping operation is performed.

As shown in FIG. 2, maintenance portions 141 and 142 are provided in the non-printing area 140. The maintenance portions 141 and 142 are respectively positioned below the movement path of the head units 100 and 200. By the control of a CPU (not shown in the drawings) of the printer 1, in the maintenance portions 141 and 142, maintenance operations are performed on the head units 100 and 200. Configurations of the maintenance portions 141 and 142 are the same. Therefore, in the following explanation, the maintenance portion 141 will be explained.

As shown in FIG. 2 and FIG. 3, the maintenance portion 141 includes the wiper 31, the nozzle cap 144, the flushing receiving portion 145, the absorption member 148 (refer to FIG. 3), and a support plate 149. The nozzle cap 144 is provided on a left portion of the maintenance portion 141. The nozzle cap 144 is a cap that is rectangular in a plan view and that opens upward. The nozzle cap 144 can be moved in the up-down direction. In a state in which the head unit 100 has moved above the nozzle cap 144, the nozzle cap 144 is moved upward and covers the nozzle surface 111. In this state, the ink purge operation is performed on the head unit 100. The ink stored in the nozzle cap 144 is discharged to a tank (not shown in the drawings) via a discharge path (not shown in the drawings).

The flushing receiving portion 145 is positioned on a right portion of the maintenance portion 141 and above a first wall portion 74 of a movement portion 63, which will be described below. The flushing receiving portion 145 includes a container portion 146 and an absorption body 147. The container portion 146 is a container that is rectangular in a plan view and that opens upward. The absorption body 147 is disposed inside the container portion 146. The absorption body 147 is a cuboid member that can absorb ink. The flushing receiving portion 145 receives ink ejected from the head unit 100 by the flushing operation. The ink is absorbed by the absorption body 147.

The wiper 31 is provided to the left of the flushing receiving portion 145. The wiper 31 can be moved in the up-down direction. When the carriage 20 is moved in the left-right direction in a state in which the wiper 31 has moved upward, the wiper 31 slides in contact with the nozzle surface 111. Consequently, the ink is removed from the nozzle surface 111 (refer to FIG. 10). That is, the first wiping operation is performed.

The support plate 149 is provided between the wiper 31 and the nozzle cap 144 in the left-right direction. The support plate 149 is a plate-shaped member that extends in the first direction and that has a rectangular shape in a plan view. As shown in FIG. 3, the absorption member 148 is attached to the bottom surface of the support plate 149 and is supported by the support plate 149. The absorption member 148 is plate shaped and extends in the first direction. The absorption member 148 can absorb ink.

The support plate 149 is moved in the left-right direction by a drive mechanism (not shown in the drawings). Consequently, the wiper 31 slides in contact with the bottom surface of the absorption member 148, so that the ink attached to the wiper 31 is removed. That is, the second wiping operation is performed. The absorption member 148 absorbs the ink attached to the absorption member 148.

Figure 4:
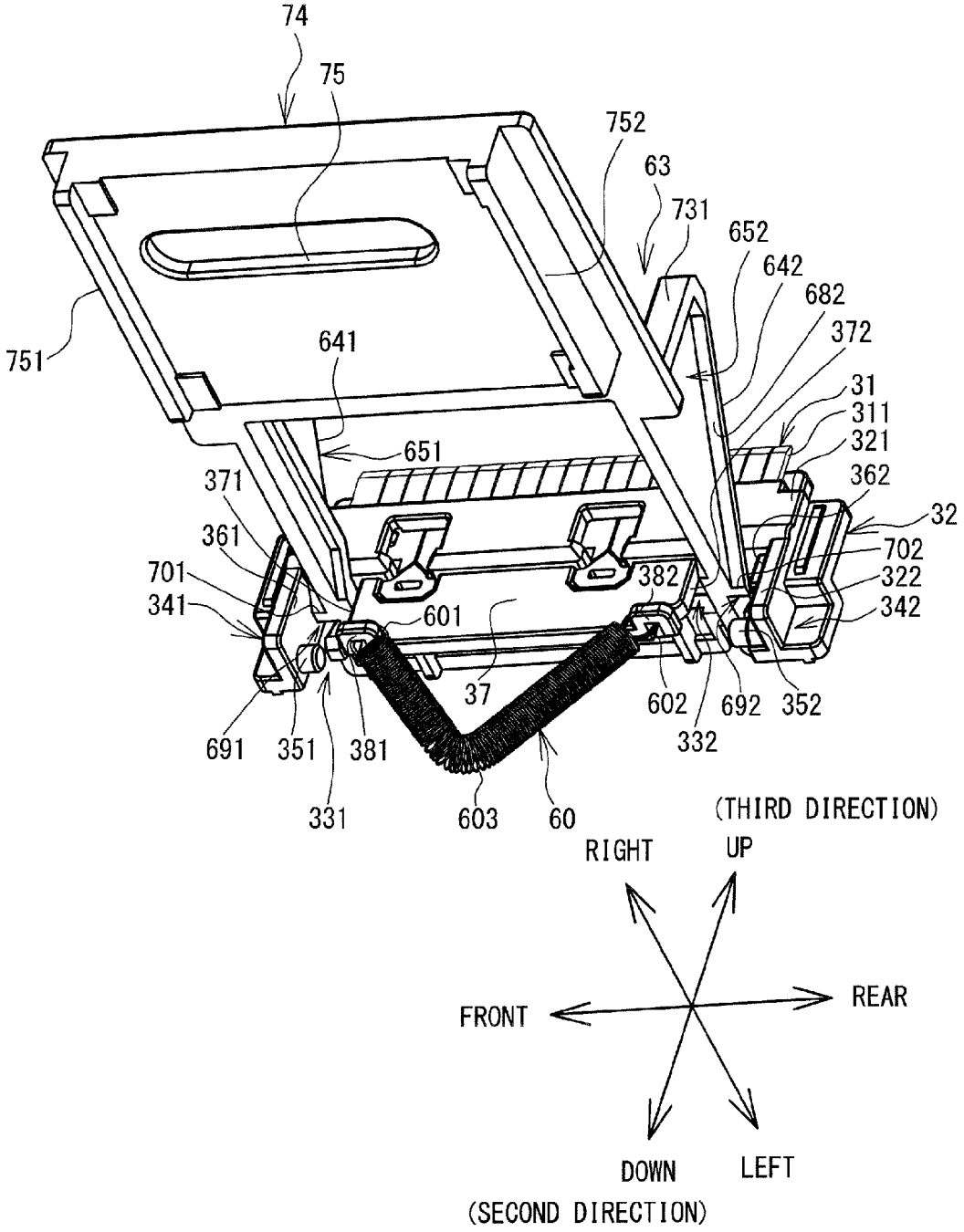
FIG. 4 is a perspective view of the wiper, the wiper support portion, a coil spring, and a movement portion.
Figure 7:
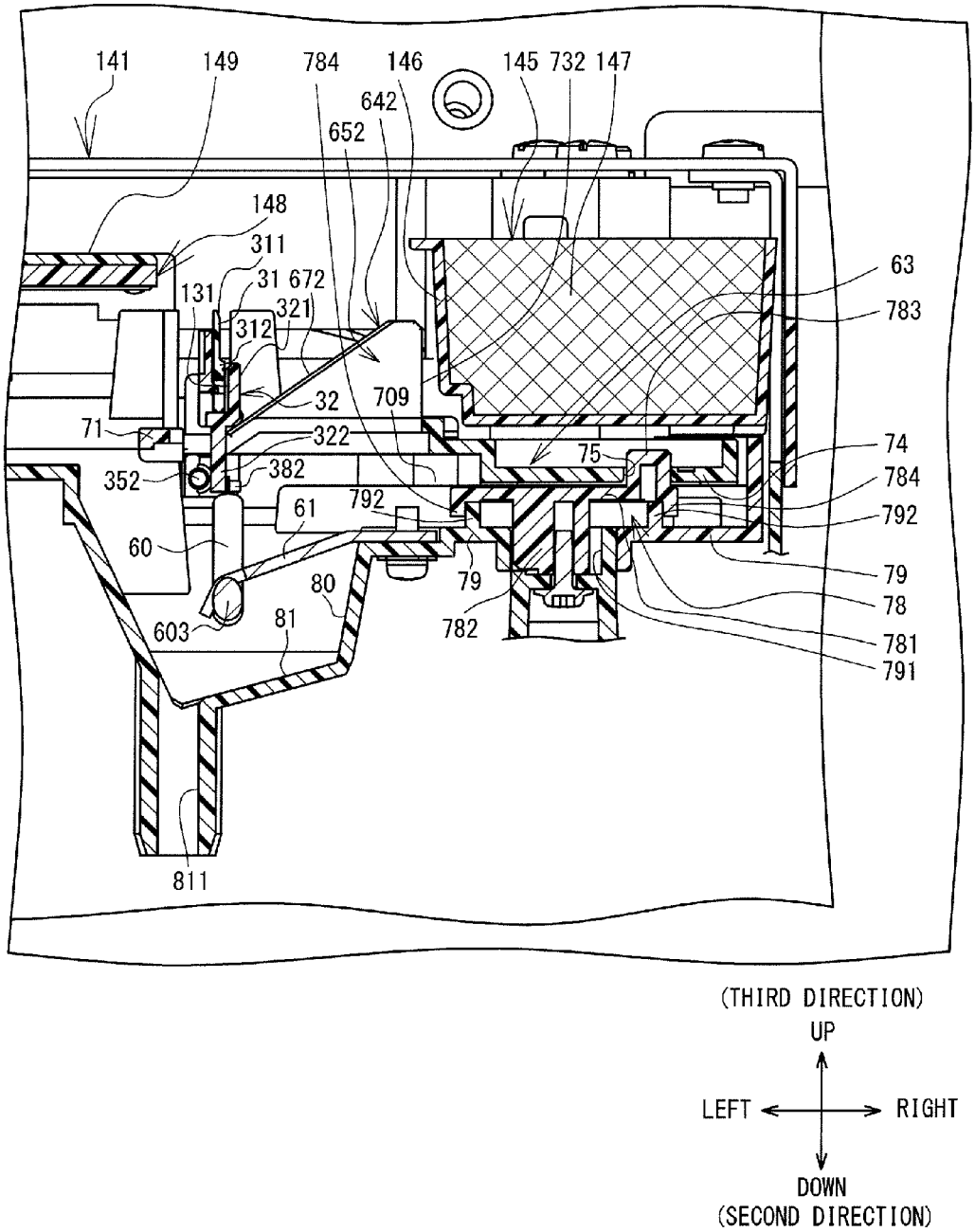
FIG. 7 is an enlarged view of a main part of FIG. 3.
Figure 8:
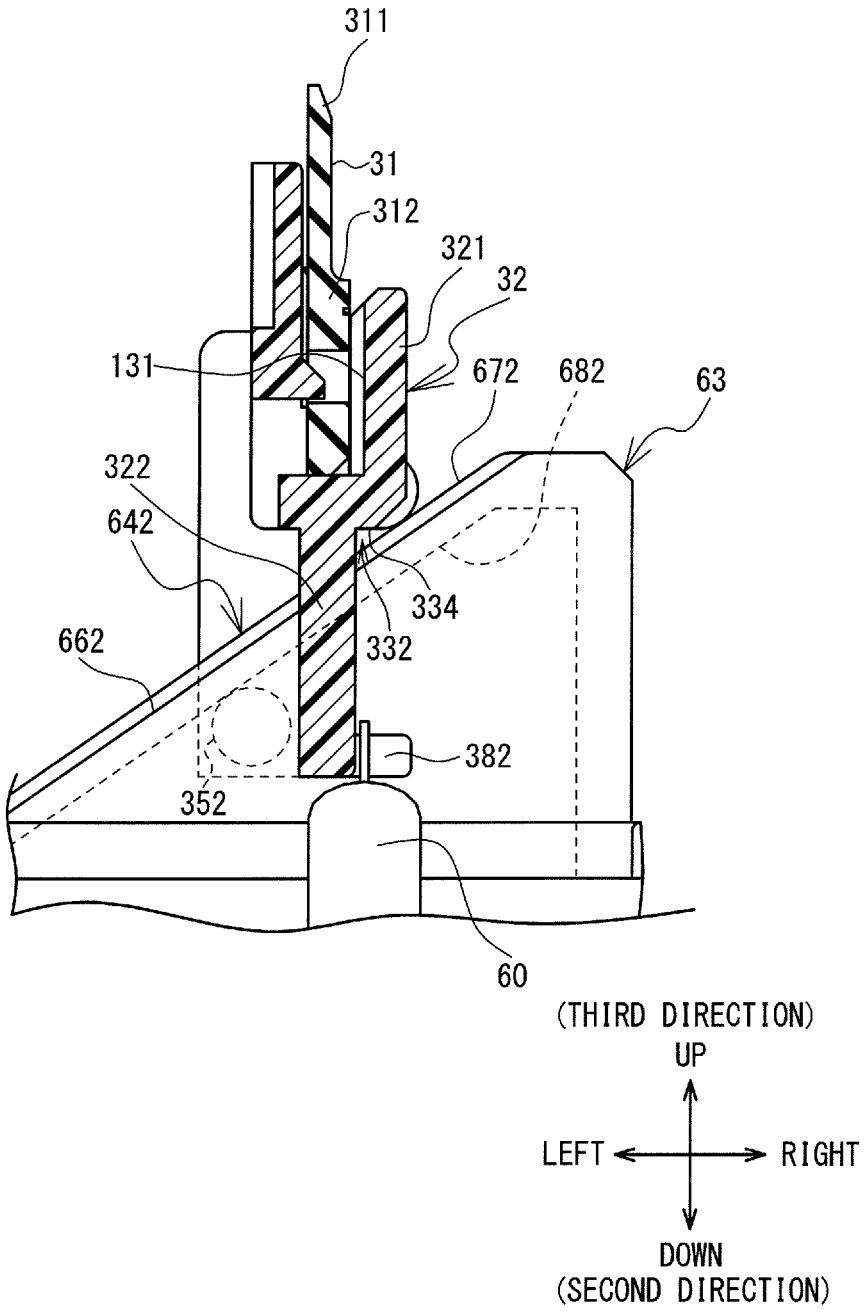
FIG. 8 is a cross-sectional view showing a process in which the wiper and the wiper support portion move from a contact position to the separated position.

A configuration to support the wiper 31 and move the wiper 31 in the up-down direction will be explained. As shown in FIG. 3 to FIG. 6, the wiper 31, a wiper support portion 32, a second spring support portion 61, guide wall portions 801 and 802, and the movement portion 63 are provided in the non-printing area 140. The wiper 31 is provided below the nozzle surface 111 in the up-down direction. A first side 311 of the wiper 31 can be opposed to the nozzle surface 111 in the up-down direction (refer to FIG. 3 and FIG. 9 to FIG. 11). In the present embodiment, the first side 311 of the wiper 31 is the upper side of the wiper 31. A second side 312 of the wiper 31 is the opposite side to the first side 311 of the wiper 31. In the present embodiment, the second side 312 of the wiper 31 is the lower side of the wiper 31. As shown in FIG. 4, the wiper 31 extends in the front-rear direction, which is parallel to the nozzle surface 111. The wiper support portion 32 is provided on the lower side of the wiper 31, which is the opposite side to the nozzle surface 111 side with respect to the wiper 31. For example, a first side 321 of the wiper support portion 32 is provided on the second side 312 of the wiper 3. In the present embodiment, the first side 321 of the wiper support portion 32 is the upper side of the wiper support portion 32. The wiper support portion 32 supports the wiper 31. The wiper support portion 32 has a rectangular shape that is long in the front-rear direction when viewed from the left side. The wiper support portion 32 has a specified width in the left-right direction. As shown in FIG. 3, FIG. 7, and FIG. 8, the wiper support portion 32 includes a recessed portion 131, which is recessed downward from the upper surface of the wiper support portion 32. A lower portion of the wiper 31 is disposed on the inside of the recessed portion 131. In the explanation below, the direction from the wiper 31 toward the wiper support portion 32 is referred to as a second direction. The second direction is orthogonal to the nozzle surface 111. In the present embodiment, the second direction is the downward direction. The direction opposite to the second direction is referred to as a third direction. In the present embodiment, the third direction is the upward direction. A second side 322 of the wiper support portion 32 is the opposite side to the first side 321 of the wiper support portion 32 in the second direction. In the present embodiment, the second side 322 of the wiper support portion 32 is the lower side of the wiper support portion 32.

As shown in FIG. 4, recessed portions 331 and 332 are respectively provided in the lower ends of end portions, in the front-rear direction, of the wiper support portion 32. The recessed portions 331 and 332 are recessed upward and penetrate through the wiper support portion 32 in the left-right direction. Sections that form outside surfaces 361 and 362 are on the outsides, in the front-rear direction, of the recessed portions 331 and 332. Sections that form the outside surfaces 361 and 362 are respectively referred to as arm portions 341 and 342. The pair of arm portions 341 and 342 are respectively provided on both the end portions, in the first direction (the front-rear direction, for example), of the wiper support portion 32. The pair of arm portions 341 and 342 extend in the second direction from central portions, in the up-down direction, of the wiper support portion 32. Engagement protrusion portions 351 and 352 are respectively provided on lower end portions of the pair of arm portions 341 and 342 of the wiper support portion 32. In the first direction (the front-rear direction, for example), the engagement protrusion portions 351 and 352 protrude toward the inside of the pair of arm portions 341 and 342. The engagement protrusion portions 351 and 352 are portions that engage with engagement portions 681 and 682 (refer to FIG. 4 and FIG. 5) of inclined portions 641 and 642, respectively.

Inner side surfaces 371 and 372 are on the insides, in the front-rear direction, of the pair of recessed portions 331 and 332. A portion that forms the inner side surfaces 371 and 372 is referred to as a wall portion 37. The wall portion 37 is a central portion of a lower end portion of the wiper support portion 32. The wall portion 37 extends in the front-rear direction. First spring support portions 381 and 382 are respectively provided on both end portions, in the first direction (the front-rear direction, for example), of the wall portion 37. The first spring support portions 381 and 382 are respectively provided below the inner side surfaces 371 and 372. The first spring support portions 381 and 382 are separated from each other in the first direction (the front-rear direction, for example). The first spring support portions 381 and 382 are hook-shaped and extend in the first direction. The first spring support portions 381 and 382 support spring end portions 601 and 602, which are both end portions of a coil spring 60. The spring end portions 601 and 602 are formed in a ring shape. The spring end portions 601 and 602 are hooked by the hook-shaped first spring support portions 381 and 382.

As shown in FIG. 2, FIG. 3, and FIG. 7, the second spring support portion 61 is provided on the second direction side of the wiper support portion 32 in the up-down direction. For example, the second spring support portion 61 is provided on the opposite side to the nozzle surface 111 with respect to the wiper support portion 32. The second spring support portion 61 is provided between the pair of first spring support portions 381 and 382 in the first direction (the front-rear direction, for example). As shown in FIG. 3 and FIG. 7, a right end portion of the second spring support portion 61 is supported by a left end portion of a third wall portion 79. The second spring support portion 61 is a metal plate that extends downward to the left from the right end portion of the second spring support portion 61, and the leading left end of the second spring support portion 61 is further bent downward. Both end portions of the coil spring 60 are respectively supported by the first spring support portions 381 and 382. The coil spring 60 is stretched downward, and a central portion 603 of the coil spring 60 is hooked onto the bottom surface of the second spring support portion 61. As a result, as shown in FIG. 4, the coil spring 60 has a V shape in which the central portion 603 is recessed in the second direction. The coil spring 60 is illustrated in a simplified manner in the drawings other than FIG. 4 and FIG. 12. The coil spring 60 is supported by the first spring support portions 381 and 382 and the second spring support portion 61. The coil spring 60 urges the wiper support portion 32 in the second direction by a restoring force and thus urges the wiper 31 in the second direction. In accordance with the movement of the movement portion 63 in the first direction (the left-right direction, for example), the wiper support portion 32 moves up and down along the guide wall portions 801 and 802 (refer to FIG. 2 and FIG. 6).

Figure 6:
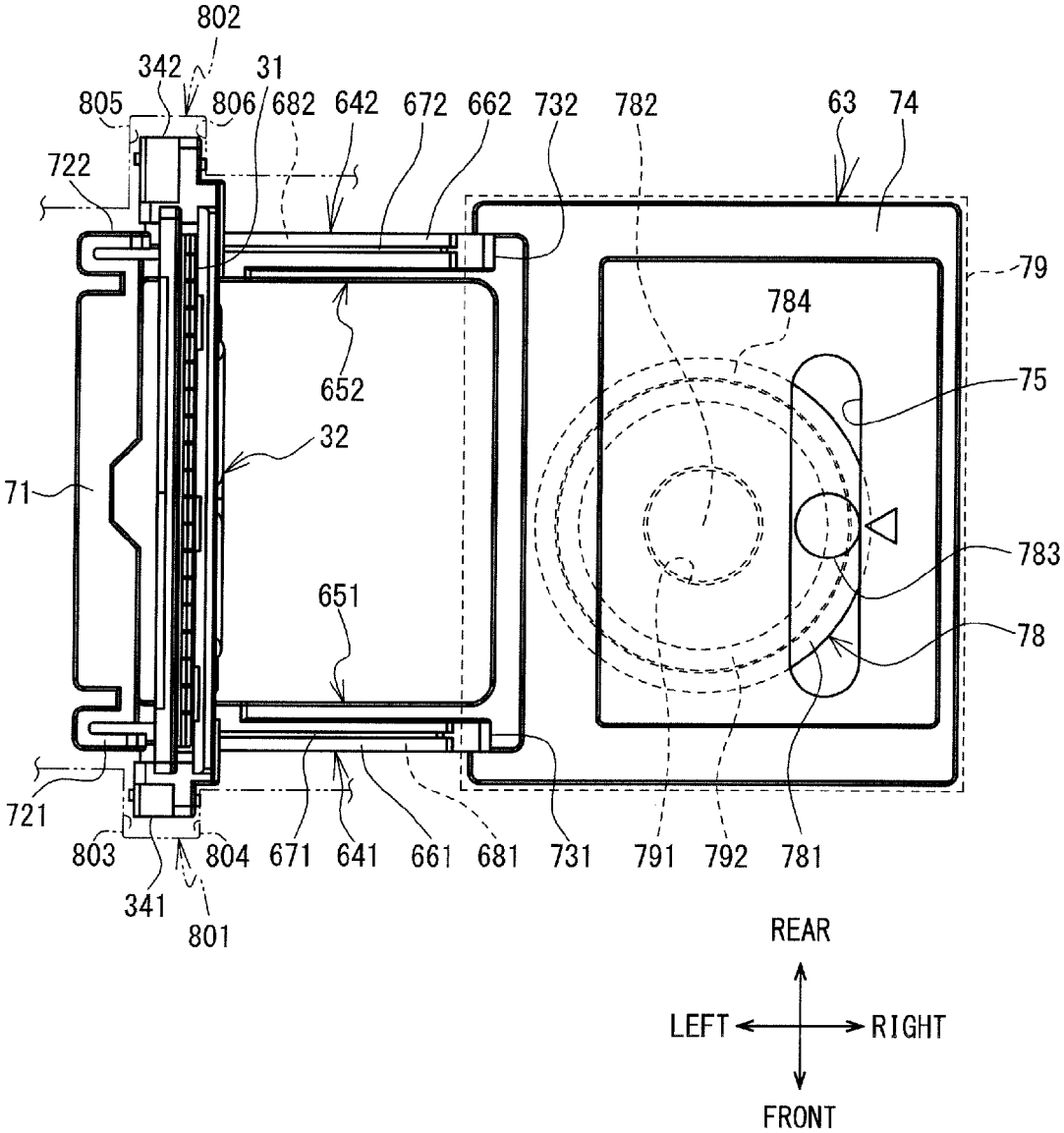
FIG. 6 is a plan view of the wiper, the wiper support portion, and the movement portion.

As shown in FIG. 6, the guide wall portions 801 and 802 extend in the up-down direction. The guide wall portions 801 and 802 are respectively formed along the arm portions 341 and 342 of the wiper support portion 32 in a plan view. The guide wall portion 801 includes a pair of wall surfaces 803 and 804. The pair of wall surfaces 803 and 804 are opposed to each other in the left-right direction. The arm portion 341 is interposed between the pair of wall surfaces 803 and 804. The guide wall portion 802 includes a pair of wall surfaces 805 and 806. The pair of wall surfaces 805 and 806 are opposed to each other in the left-right direction. The arm portion 342 is interposed between the pair of wall surfaces 805 and 806. Therefore, the guide wall portions 801 and 802 can restrict the movement of the wiper support portion 32 in the left-right direction. The guide wall portions 801 and 802 can guide the up and down movement of the wiper 31 and the wiper support portion 32 between a contact position (refer to FIG. 9 and FIG. 10) and a separated position (refer to FIG. 3 and FIG. 7). The contact position is a position of the wiper 31 and the wiper support portion 32 in which the wiper 31 can contact with the nozzle surface 111. The separated position is a position of the wiper 31 and the wiper support portion 32 in which the wiper 31 is separated from the nozzle surface 111.

Figure 5:
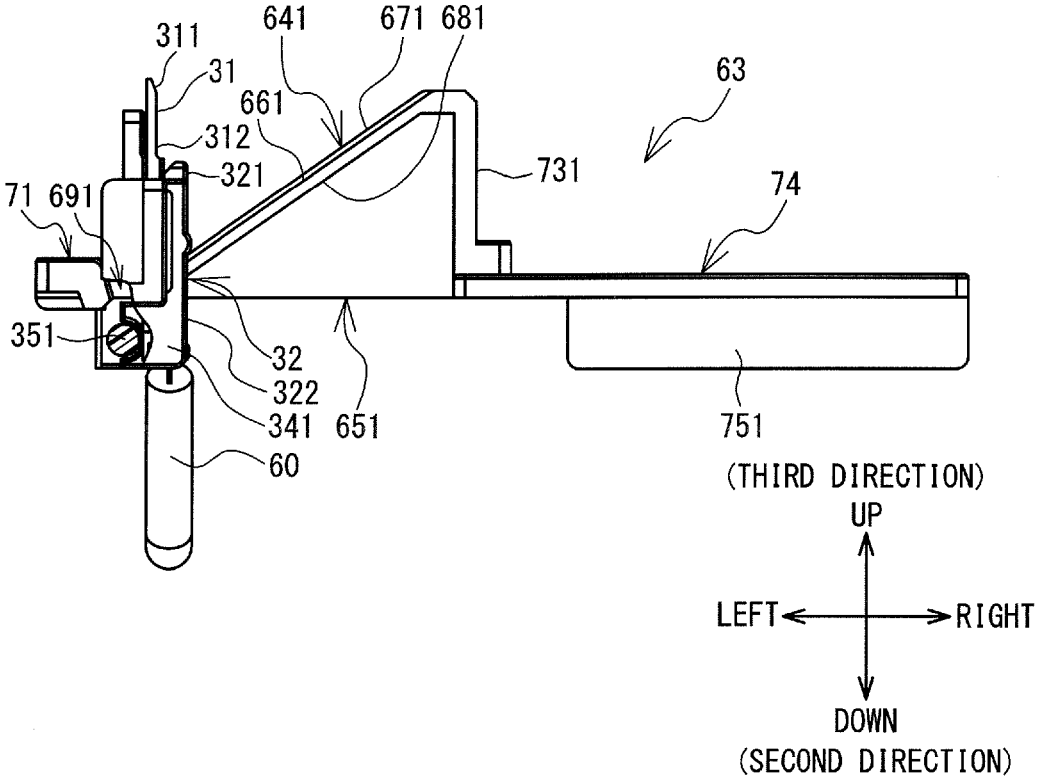
FIG. 5 is a front side view of the wiper, the wiper support portion, a part of which is shown in cross section, the coil spring, and the movement portion.

As shown in FIG. 4 to FIG. 6, the movement portion 63 includes facing wall portions 651 and 652 and the first wall portion 74. The pair of facing wall portions 651 and 652 are opposed to each other in the first direction (the front-rear direction, for example). Each of the facing wall portions 651 and 652 has a substantially triangle shape in a side view. The facing wall portion 651 includes the inclined portion 641, a first contact protrusion portion 671, the engagement portion 681, and an opening portion 691. The facing wall portion 652 includes the inclined portion 642, a first contact protrusion portion 672, the engagement portion 682, and an opening portion 692.

The pair of inclined portions 641 and 642 are opposed to each other in the first direction (the front-rear direction, for example). The pair of inclined portions 641 and 642 are positioned on the second side of the wiper support portion 32. The pair of inclined portions 641 and 642 are inclined in the second direction with respect to the first direction (the left-right direction, for example). For example, the inclined portions 641 and 642 form upper portions of the facing wall portions 651 and 652. The inclined portions 641 and 642 extend downward and diagonally to the left. As will be described in detail below, in accordance with the movement of the movement portion 63 in the first direction (the left-right direction, for example), the inclined portions 641 and 642 moves in the first direction (the left-right direction, for example). In accordance with the movement of the inclined portions 641 and 642, the inclined portions 641 and 642 move the wiper 31 and the wiper support portion 32 between the contact position (refer to FIG. 9 and FIG. 10) and the separated position (refer to FIG. 3 and FIG. 7).

As shown in FIG. 5 and FIG. 6, upper surfaces 661 and 662 are surfaces on the third direction side of the inclined portions 641 and 642. The first contact protrusion portions 671 and 672 respectively protrude in the third direction from central portions, in the front-rear direction, of the upper surfaces 661 and 662. The first contact protrusion portions 671 and 672 extend downward and diagonally to the left along the inclined portions 641 and 642.

As shown in FIG. 4 and FIG. 8, the engagement portions 681 and 682 are recessed portions in side surfaces on the outsides, in the first direction (the front-rear direction, for example), of the inclined portions 641 and 642. The engagement portions 681 and 682 are recessed toward the inside, in the first direction (the front-rear direction, for example), of the inclined portions 641 and 642. In the present embodiment, end portions on the outsides, in the first direction (the front-rear direction, for example), of the inclined portions 641 and 642 are plate shaped and protrude outward in the first direction (the front-rear direction, for example). The engagement portions 681 and 682 are formed by bottom surfaces of the inclined portions 641 and 642, respectively. The engagement portions 681 and 682 extend downward and diagonally to the left along the inclined portions 641 and 642, respectively.

The engagement portions 681 and 682 respectively engage with the engagement protrusion portions 351 and 352 of the wiper support portion 32. At this time, the inclined portions 641 and 642 are arranged on the insides of the recessed portions 331 and 332 of the wiper support portion 32. As shown in FIG. 8, the first contact protrusion portions 671 and 672 contact with the wiper support portion 32. For example, the first contact protrusion portions 671 and 672 contact with upper surfaces 334 of the recessed portions 331 and 332, respectively. FIG. 8 shows the upper surface 334 of the recessed portion 332. When the wiper 31 is moved between the separated position (refer to FIG. 3 and FIG. 7) and the contact position (refer to FIG. 9 and FIG. 10), the engagement protrusion portions 351 and 352 of the wiper support portion 32 slide with respect to the engagement portions 681 and 682, respectively.

As shown in FIG. 4 and FIG. 5, the opening portions 691 and 692 are respectively provided on end portions on the second direction side of the inclined portions 641 and 642.

For example, the opening portion 691 and 692 are respectively provided on the end portions, of the inclined portions 641 and 642, farthest from the nozzle surface 111. The opening portions 691 and 692 are formed such that side surfaces on the outsides, in the first direction (the front-rear direction), of the facing wall portions 651 and 652 are open in the up-down direction. The opening portions 691 and 692 respectively connect to end portions 701 and 702 on the second direction side of the engagement portions 681 and 682. The engagement protrusion portions 351 and 352 of the wiper support portion 32 can be attached to and detached from the engagement portions 681 and 682 via the opening portions 691 and 692, respectively.

As shown in FIG. 5 and FIG. 6, an extension portion 71 extends between the end portions on the second direction side of the inclined portions 641 and 642. For example, the extension portion 71 extends between end portions, of the inclined portions 641 and 642, farthest from the nozzle surface 111. The extension portion 71 is plate shaped and extends in the first direction. The extension portion 71 has flexibility in the up-down direction. As shown in FIG. 5, the extension portion 71 is positioned further to the left than the opening portions 691 and 692. As shown in FIG. 6, tab portions 721 and 722 protrude from both end portions, in the first direction (the front-rear direction, for example), of the extension portion 71 toward the outside in the first direction (the front-rear direction, for example). Each of the tab portions 721 and 722 has in a hook shape in a plan view. The facing wall portions 651 and 652 and the inclined portions 641 and 642 have flexibility in the first direction (the front-rear direction, for example). When an operator grasps the tab portions 721 and 722 and pushes the tab portions 721 and 722 to the inside in the first direction (the front-rear direction, for example), the extension portion 71 deflects in the up-down direction and the inclined portions 641 and 642 deflect toward the inside of the inclined portions 641 and 642.

As shown in FIG. 5 and FIG. 6, extending wall portions 731 and 732 form rear end portions of the facing wall portions 651 and 652. The extending wall portions 731 and 732 extend in the up-down direction. The upper ends of the extending wall portions 731 and 732 are connected to end portions on the third direction side of the inclined portions 641 and 642, respectively.

As shown in FIG. 4 to FIG. 6, the first wall portion 74 extends in the first direction and has a rectangular shape in a plan view. Left portions of both end portions, in the first direction (for example, the front-rear direction), of the first wall portion 74 are respectively connected to the lower ends of the extending wall portions 731 and 732. In other words, the first wall portion 74 is coupled with the end portions on the third direction side of the inclined portions 641 and 642 via the extending wall portions 731 and 732. As shown in FIG. 4 and FIG. 6, a long hole 75 is provided in a right portion of the first wall portion 74. The long hole 75 penetrates through the first wall portion 74 in the up-down direction. The long hole 75 extends in the direction orthogonal to the movement direction of the inclined portion 641 and 642. For, example, the long hole 75 extends in the front-rear direction.

As shown in FIG. 4 and FIG. 5, wall portions 751 and 752 are respectively provided on both end portions, in the front-rear direction, of the first wall portion 74. The wall portions 751 and 752 protrude downward from the first wall portion 74. The wall portions 751 and 752 are disposed on the insides of groove portions (not shown in the drawings) provided on both end portions, in the front-rear direction, of the third wall portion 79 (refer to FIG. 7). The groove portions extend in the left-right direction.

The printer 1 includes a rotary member 78. The movement portion 63 can be moved in the left-right direction in conjunction with the rotation of the rotary member 78. As shown in FIG. 6 and FIG. 7, the rotary member 78 is positioned on the second direction side of the first wall portion 74. The rotary member 78 includes a second wall portion 781, a drive shaft 782, a shaft portion 783, and a first protruding wall portion 784. The second wall portion 781 is opposed to the first wall portion 74 on the second direction side of the first wall portion 74. For example, the second wall portion 781 is provided on the opposite side to the nozzle surface 111 with respect to the first wall portion 74. The second wall portion 781 has a circular shape and extends in the first direction. The drive shaft 782 extends in the up-down direction. The upper end of the drive shaft 782 is connected to a central portion of the bottom surface of the second wall portion 781. The drive shaft 782 is connected to the drive mechanism (not shown in the drawings) that includes a motor, a gear, and the like. The drive shaft 782 can be rotated in accordance with the drive of the drive mechanism and can rotate the second wall portion 781.

The shaft portion 783 extends in the up-down direction. The lower end of the shaft portion 783 is connected to an outer peripheral portion of an upper surface of the second wall portion 781. The shaft portion 783 is positioned on the outside of the center of rotation of the drive shaft 782. The shaft portion 783 is inserted through the long hole 75. The first protruding wall portion 784 extends in the second direction from the periphery of the second wall portion 781.

The third wall portion 79 is provided on the second direction side of the second wall portion 781 and the first protruding wall portion 784, the third wall portion 79 is provided on the opposite side to the nozzle surface 111 with respect to the second wall portion 781. The third wall portion 79 has a rectangular shape in a plan view and extends in the first direction. The shape of the third wall portion 79 shown in FIG. 6 is schematically illustrated. The third wall portion 79 may be larger or smaller than the third wall portion 79 shown in FIG. 6. The third wall portion 79 includes a hole 791, which penetrates in the up-down direction. The drive shaft 782 is inserted through the hole 791 (refer to FIG. 7). A second protruding wall portion 792 is connected to the third wall portion 79. The second protruding wall portion 792 is provided on the inside of the first protruding wall portion 784 in the first direction. For example, the second protruding wall portion 792 is disposed along an inner surface of the first protruding wall portion 784 in the first direction. The second protruding wall portion 792 extends in the third direction. In the first direction, the hole 791 is positioned at the center of the first protruding wall portion 784 and the second protruding wall portion 792.

As shown in FIG. 7, an inclined surface 80 is connected to a left end portion of the third wall portion 79. The inclined surface 80 is inclined to the second direction with respect to the first direction. For example, the inclined surface 80 is inclined downward and diagonally to the left. An end portion on the second direction side of the inclined surface 80 is connected to a discharge wall portion 81. For example, the discharge wall portion 81 is connected to the end portion, of the inclined surface 80, farthest from the nozzle surface 111. The discharge wall portion 81 forms a discharge opening 811. The discharge opening 811 is an opening portion configured to discharge ink. The discharge opening 811 is connected to a tank (not shown in the drawings) that can store the discharged ink.

The first wiping operation, in which the ink is wiped away from the nozzle surface 111 by the wiper 31, will be explained. The first wiping operation is performed by the CPU controlling the printer 1 in accordance with a program stored in a memory (not shown in the drawings). As shown in FIG. 3 and FIG. 7, it is assumed that the wiper 31 is in the separated position. At this time, the shaft portion 783 and the movement portion 63 are positioned on the rightmost side. The CPU drives the drive mechanism (not shown in the drawings) to move the wiper 31 from the separated position to the contact position. Thus, the second wall portion 781 is rotated via the drive shaft 782, and the shaft portion 783 is moved around the drive shaft 782. The shaft portion 783 pushes the first wall portion 74 to the left while sliding inside the long hole 75. As a result, as shown in FIG. 8, the movement portion 63 is moved to the left and the inclined portions 641 and 642 are moved to the left. The wiper support portion 32 is restricted from moving in the left-right direction by the guide wall portions 801 and 802 (refer to FIG. 6). Therefore, in accordance with the movement of the inclined portions 641 and 642, the wiper support portion 32 is moved in the third direction along the inclined portions 641 and 642 against the urging force of the coil spring 60, while being guided by the guide wall portions 801 and 802. At this time, the first contact protrusion portions 671 and 672 contact with the upper surfaces 334 of the recessed portions 331 and 332.

Figure 9:
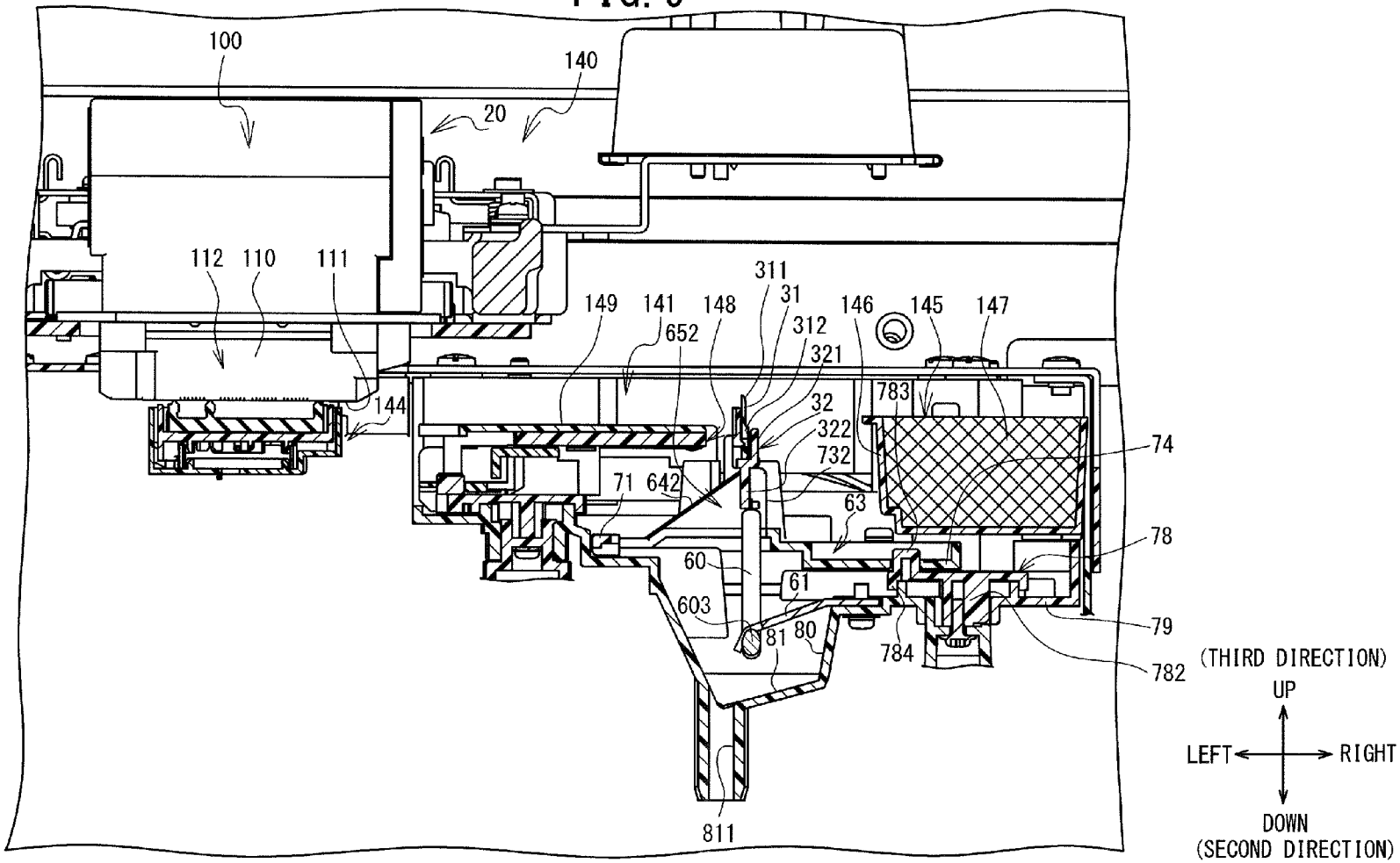
FIG. 9 is a cross-sectional view showing a state in which the wiper and the wiper support portion have moved to the contact position.

As shown in FIG. 9, the CPU stops the drive of the drive mechanism. At this time, the shaft portion 783 and the movement portion 63 are positioned on the leftmost side. The wiper 31 and the wiper support portion 32 are positioned in the contact position.

The CPU drives the drive motor 19 (refer to FIG. 1) to move the head unit 100 to the right. As shown in FIG. 10, the wiper 31 that is in the contact position contacts with the nozzle surface 111. The wiper 31 wipes away the excessive ink remaining on the nozzle surface 111. The head unit 100 may reciprocate a plurality of times with respect to the wiper 31 and the wiper 31 may wipe away the ink a plurality of times.

Next, the CPU drives the drive mechanism to move the wiper 31 from the contact position to the separated position. The second wall portion 781 is rotated via the drive shaft 782, and the shaft portion 783 is moved around the drive shaft 782. The shaft portion 783 pushes the first wall portion 74 to the right while sliding inside the long hole 75. As a result, the movement portion 63 is moved to the right. Accordingly, the inclined portions 641 and 642 are moved to the right. The wiper support portion 32 is restricted from moving in the left-right direction by the guide wall portions 801 and 802. Therefore, in accordance with the movement of the inclined portions 641 and 642, the wiper support portion 32 is moved in the second direction along the inclined portions 641 and 642 due to the urging force of the coil spring 60, while being guided by the guide wall portions 801 and 802. Although not shown in the drawings, in a similar manner to the case shown in FIG. 3 and FIG. 7, the wiper 31 is moved to the separated position. In the manner described above, the first wiping operation is performed.

After the first wiping operation is completed, the second wiping operation is performed. The CPU drives the drive mechanism to move the movement portion 63 and thus causes the wiper 31 and the wiper support portion 32 to move to a position, in the up-down direction, in which the wiper 31 contacts with the absorption member 148. The CPU causes the support plate 149 to move to the right and causes the wiper 31 to slide in contact with the bottom surface of the absorption member 148. In this manner, the second wiping operation is performed.

When the first wiping operation and the second wiping operation are performed a plurality of times, the wiper 31 may become dirty with ink or deteriorate. In this case, the operator may replace the wiper 31 with a new wiper 31. The method of replacing the wiper 31 will be explained. As shown in FIG. 4, FIG. 5, and FIG. 7, it is assumed that the wiper support portion 32 has moved to the end portions on the second direction side of the inclined portions 641 and 642 and the wiper 31 is in the separated position. At this time, the wiper support portion 32 is urged in the second direction due to the urging force of the coil spring 60. Therefore, the engagement protrusion portions 351 and 352 do not slip out from the opening portions 691 and 692 to the third direction side, and the wiper support portion 32 is mounted on the inclined portions 641 and 642.

Figure 12:
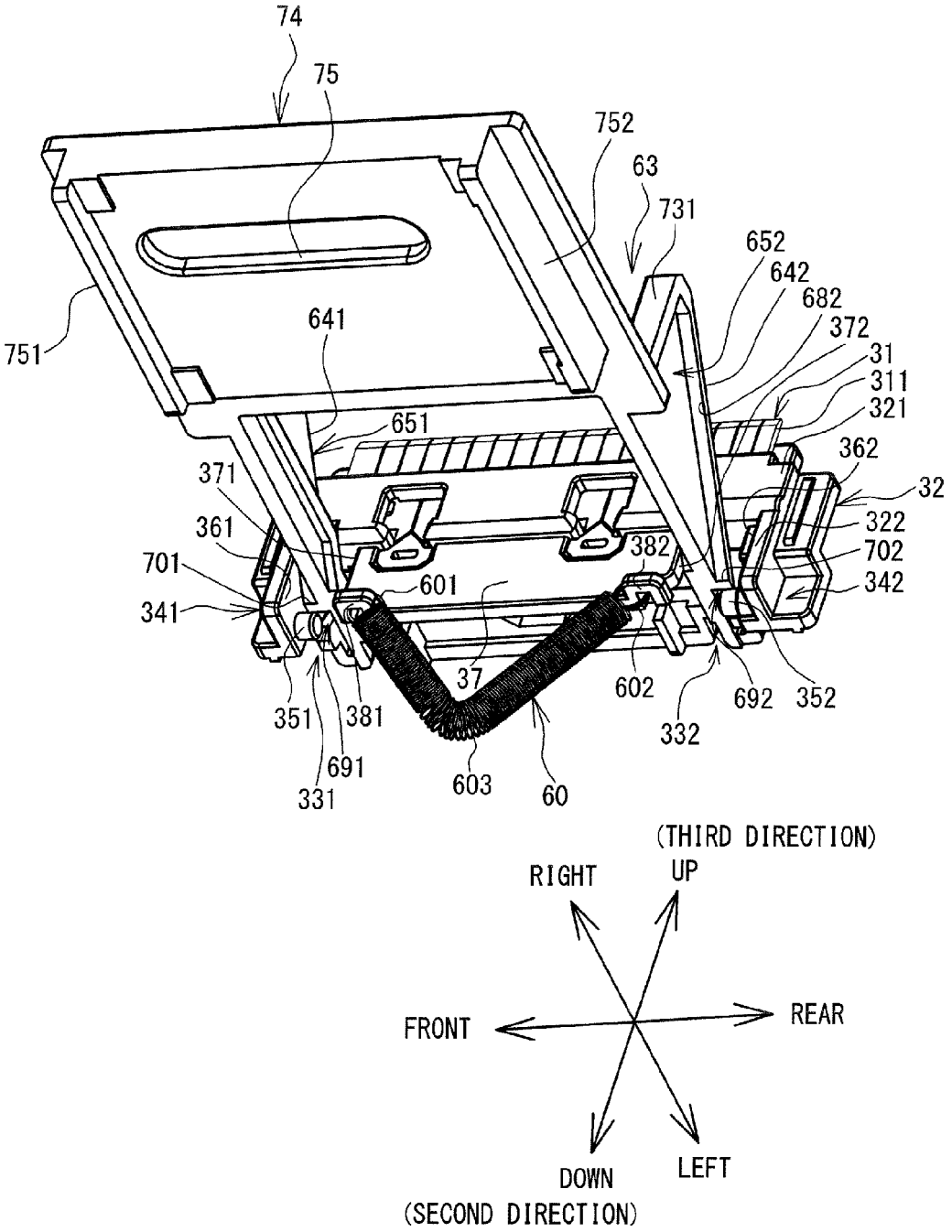
FIG. 12 is a perspective view of the wiper, the wiper support portion, the coil spring, and the movement portion, and shows a process in which the wiper support portion is removed from inclined portions.
Figure 13:
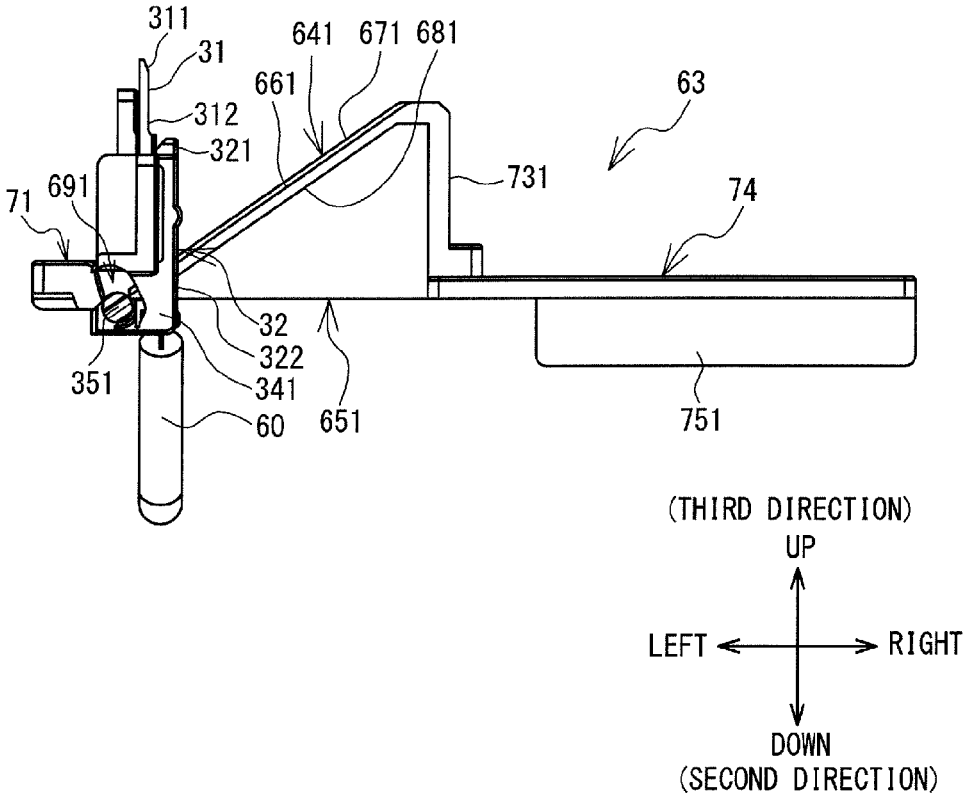
FIG. 13 is a front side view of the wiper, the wiper support portion, a part of which is shown in cross section, the coil spring, and the movement portion, and shows a process in which the wiper support portion is removed from the inclined portions.

When the wiper 31 is replaced, the coil spring 60 is removed from the second spring support portion 61 (refer to FIG. 7). Next, the wiper support portion 32 is gripped by the operator and is raised in the third direction. As a result, as shown in FIG. 12 and FIG. 13, the engagement protrusion portions 351 and 352 start to pass through the opening portions 691 and 692 in the third direction. Although not shown in the drawings, when the wiper support portion 32 is further raised in the third direction, the engagement protrusion portions 351 and 352 move further to the third direction side than the opening portions 691 and 692 and thus the wiper support portion 32 is removed from the inclined portions 641 and 642. After the wiper support portion 32 is removed from the inclined portions 641 and 642, the coil spring 60 is removed from the second spring support portion 61.

The wiper 31 is removed from the wiper support portion 32 and another new wiper 31 is mounted on the wiper support portion 32. Alternatively, another new wiper support portion 32, on which the new wiper 31 is mounted in advance, may be prepared. When the wiper support portion 32 is mounted on the inclined portions 641 and 642, the wiper support portion 32 is gripped by the operator and is moved in the second direction from the third direction side of the inclined portions 641 and 642. After the engagement protrusion portions 351 and 352 pass though the opening portions 691 and 692 in the second direction, the coil spring 60 is attached to the second spring support portion 61. In this state, the wiper support portion 32 is urged in the second direction, and the wiper 31 and the wiper support portion 32 are held in the separated position, as shown in FIG. 4, FIG. 5, and FIG. 7. That is, the wiper 31 is mounted on the printer 1.

When the operator mounts the wiper 31 on the printer 1 and removes the wiper 31 from the printer 1, the operator may grasp the tab portions 721 and 722 and press down the tab portions 721 and 722 to the inside. Thus, the extension portion 71 deflects upward or downward and the inclined portions 641 and 642 deflect inward in the front-rear direction. Thus, the positions of the opening portions 691 and 692 are moved to the inside. Accordingly, in comparison to a case in which the opening portions 691 and 692 are not moved to the inside, the engagement protrusion portions 351 and 352 can be easily attached to and detached from the engagement portions 681 and 682 via the opening portions 691 and 692.

In the present embodiment, only when the wiper support portion 32 is on the end portions on the second direction side of the inclined portions 641 and 642, the engagement protrusion portions 351 and 352 can be separated from the engagement portions 681 and 682 via the opening portions 691 and 692 and thus the wiper 31 can be removed from the printer 1. On the inclined portions 641 and 642, a section at which the wiper 31 can be mounted and removed is not provided within the range of the movement of the wiper 31 between the contact position and the separated position. Accordingly, the engagement protrusion portions 351 and 352 can appropriately slide with respect to the engagement portions 681 and 682, respectively (refer to FIG. 8). Therefore, it is possible to reduce the possibility that the wiper 31 is unsteady or comes off from the printer 1 in the course of the movement of the wiper 31 between the contact position and the separated position. Therefore, the wiper 31 can be correctly disposed in the contact position and the wiper 31 can appropriately slide in contact with the nozzle surface 111. For that reason, it is possible to reduce the possibility that the ink remains on the nozzle surface 111. It is therefore possible to reduce the possibility that the ink remaining on the nozzle surface 111 is fixed. It is also possible to reduce the possibility that it becomes difficult to eject ink from the nozzle surface 111. It is desirable that a printer has a structure in which a wiper can be easily replaced, especially when the area inside the printer to replace the wiper is narrow. In the printer 1 of the present embodiment, the wiper 31 can be easily replaced by detaching and attaching the engagement protrusion portions 351 and 352 from and to the engagement portions 681 and 682 via the opening portions 691 and 692.

The wiper 31 is urged in the second direction by the coil spring 60, and the movement of the engagement protrusion portions 351 and 352 in the third direction is restricted by the engagement portions 681 and 682. Thus, it is becomes difficult for the wiper support portion 32 to be unsteady with respect to the inclined portions 641 and 642 or come off from the inclined portions 641 and 642. Therefore, the wiper 31 can be correctly disposed in the contact position and can appropriately slide in contact with the nozzle surface 111. For that reason, it is possible to reduce the possibility that the ink remains on the nozzle surface 111. It is therefore possible to reduce the possibility that the ink remaining on the nozzle surface 111 is fixed. It is also possible to reduce the possibility that it becomes difficult to eject ink from the nozzle surface 111.

The extension portion 71 extends between the inclined portions 641 and 642. Therefore, in comparison to a case in which the extension portion 71 is not provided, it is difficult for the inclined portions 641 and 642 to warp outward in the front-rear direction. Therefore, the position of the inclined portions 641 and 642 is stabilized. Accordingly, it becomes easy for the wiper support portion 32 and the wiper 31 to move between the separated position and the contact position. For that reason, the wiper 31 can be correctly disposed in the contact position and thus it is possible to reduce the possibility that the ink remains on the nozzle surface 111. It is therefore possible to reduce the possibility that the ink remaining on the nozzle surface 111 is fixed. It is also possible to reduce the possibility that it becomes difficult to eject ink from the nozzle surface 111.

The first spring support portions 381 and 382 are separated from each other in the first direction (the front-rear direction, for example). The first spring support portions 381 and 382 can be urged in the second direction by the coil spring 60. Accordingly, in comparison to a case in which a support portion in a single location is urged by the coil spring 60, the posture of the wiper support portion 32 can be stabilized. Accordingly, the posture of the wiper 31 can be stabilized and thus it is possible to reduce the possibility that the ink remains on the nozzle surface 111. It is therefore possible to reduce the possibility that the ink remaining on the nozzle surface 111 is fixed. It is also possible to reduce the possibility that it becomes difficult to eject ink from the nozzle surface 111.

The first contact protrusion portions 671 and 672 contact with the wiper support portion 32, more specifically, the upper surfaces 334 of the recessed portions 331 and 332. Therefore, in comparison to a case in which the whole, in the front-rear direction, of the upper surfaces 661 and 662 of the inclined portions 641 and 642 contact with the wiper support portion 32, the area of sections of the inclined portions 641 and 642 that contact with the wiper support portion 32 can be reduced. Therefore, the pressure of contact with the wiper support portion 32 can be increased. Consequently, it becomes difficult for the wiper support portion 32 to be unsteady with respect to the inclined portions 641 and 642.

There is a possibility that the ink wiped away from the nozzle surface 111 by the wiper 31 moves in the second direction by the force of gravity and moves to between the first contact protrusion portions 671 and 672 and the recessed portions 331 and 332. The first contact protrusion portions 671 and 672 are the sections, of the inclined portions 641 and 642, that contact with the wiper support portion 32. The area of the sections, of the inclined portions 641 and 642, that contact with the wiper support portion 32 is small. Therefore, it is possible to reduce the possibility that the ink is attached between the wiper support portion 32 and the inclined portions 641 and 642. It is also possible to reduce the possibility that the wiper support portion 32 and the inclined portions 641 and 642 are fixed to each other due to the fixing of the ink. Therefore, the wiper 31 can operate correctly and thus it is possible to reduce the possibility that the ink remains on the nozzle surface 111. It is therefore possible to reduce the possibility that the ink remaining on the nozzle surface 111 is fixed. It is also possible to reduce the possibility that it becomes difficult to eject ink from the nozzle surface 111.

As shown in FIG. 7, for example, there is a case in which the ink runs along the wiper 31 and the wiper support portion 32 and moves in the second direction. In this case, there is a possibility that the ink flows onto the upper side of the second wall portion 781. Even in this case, the second wall portion 781 can inhibit the ink from flowing into the hole 791. The drive shaft 782 is inserted through the hole 791. The first protruding wall portion 784 is positioned on the outside of the second protruding wall portion 792. Therefore, the liquid flowing to the second wall portion 781 may move to the outside of the first protruding wall portion 784 and the second protruding wall portion 792 (refer to an arrow 901 in FIG. 11) when the liquid moves from the periphery of the first wall portion 74 to the third wall portion 79 side. There is a possibility that the ink runs along the third wall portion 79 and moves toward the hole 791 side (refer to an arrow 902 in FIG. 11). Even in this case, the second protruding wall portion 792 can inhibit the ink from flowing into the hole 791. Further, the ink moved to the third wall portion 79 runs along the inclined surface 80 and is discharged from the discharge opening 811 (refer to an arrow 903 in FIG. 11). Therefore, it is possible to inhibit a large amount of the ink from being stored on the third wall portion 79 and thus it is possible to inhibit the ink from moving to the hole 791. Thus, it is possible to inhibit the ink from moving via the hole 791 and affecting the drive mechanism (not shown in the drawings) that is configured to drive the drive shaft 782. Therefore, the wiper 31 can operate correctly due to the drive of the drive shaft 782 and thus it is possible to reduce the possibility that the ink remains on the nozzle surface 111. It is therefore possible to reduce the possibility that the ink remaining on the nozzle surface 111 is fixed. It is also possible to reduce the possibility that it becomes difficult to eject ink from the nozzle surface 111.

Various changes may be made to the above-described embodiment. For example, the engagement protrusion portions 351 and 352 and the engagement portions 681 and 682 may have other shapes as long as the engagement protrusion portions 351 and 352 can respectively engage with the engagement portions 681 and 682. For example, the engagement portions 681 and 682 may be recessed portions in which surfaces on the insides, in the front-rear direction, of the inclined portions 641 and 642 are recessed outwardly. In this case, the engagement protrusion portions 351 and 352 may protrude to the outside in the front-rear direction of the wiper support portion 32.

The member that urges the wiper support portion 32 is not limited to the coil spring 60, and may be a synthetic resin member having elasticity, such as a rubber member, for example. The coil spring 60 may be connected to the wiper support portion 32 at one location. The coil spring 60 may be directly connected to the wiper 31 and may urge the wiper 31 in the second direction. The direction in which the tab portions 721 and 722 protrude is not limited and, for example, the tab portions 721 and 722 may protrude in the second direction or the third direction. The shape of the tab portions 721 and 722 is not limited and, for example, may be a rod shape. The tab portions 721 and 722 need not necessarily be provided. The extension portion 71 need not necessarily be provided. The first wall portion 74 may be directly connected to the end portions on the third direction side of the inclined portions 641 and 642. In this case, it is sufficient if the third wall portion 79, the rotary member 78, and the like are disposed higher than in the case of the above-described embodiment. Further, the liquid ejected from the nozzle surface 111 is not limited to ink and may be a discharge agent that removes a color with which a fabric has been dyed.

Figure 14:
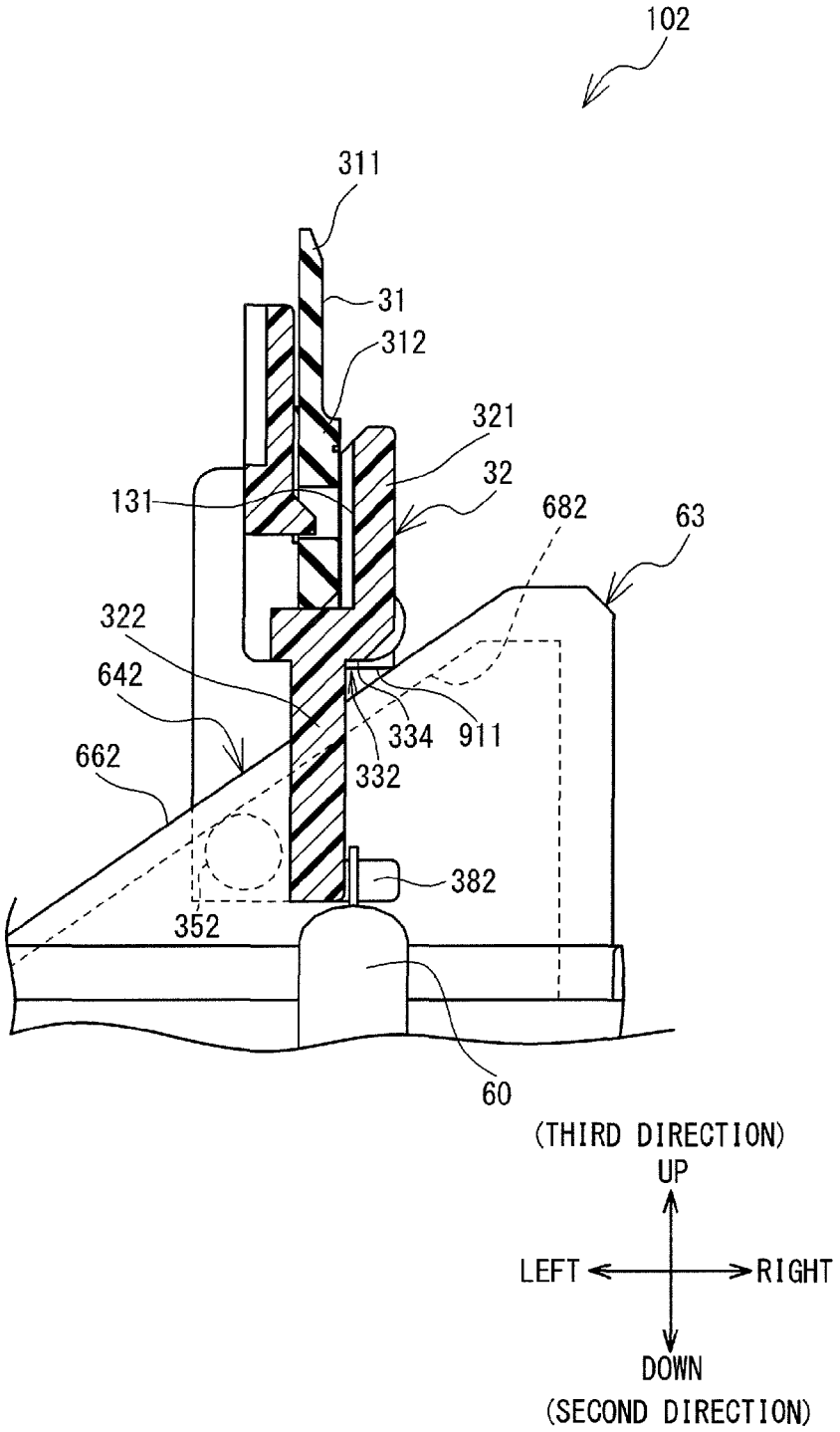
FIG. 14 is a cross-sectional view showing a process in which the wiper and the wiper support portion of a printer according to a modified example move from the contact position to the separated position.

FIG. 14 shows a printer 102 according to a modified example. As in the printer 102, second contact protrusion portions 911 may be provided on the wiper support portion 32. The second contact protrusion portions 911 are respectively provided on surfaces on the second direction side of the wiper support portion 32. For example, the second contact protrusion portions 911 are respectively provided on sections, in the front-rear direction, of the upper surfaces 334 on the third direction side of the recessed portions 331 and 332. The second contact protrusion portions 911 are provided across the upper surfaces 334 in the left-right direction and protrude in the second direction. FIG. 14 shows only the second contact protrusion portion 911 on the recessed portion 332 side. The second contact protrusion portions 911 contacts with the upper surfaces 661 and 662 of the inclined portions 641 and 642. The first contact protrusion portions 671 and 672 (refer to FIG. 6 and FIG. 8) are not provided on the upper surfaces 661 and 662 of the printer 102.

In the printer 102 according to the modified example, the second contact protrusion portions 911 contacts with the inclined portions 641 and 642. Therefore, in comparison to a case in which the whole, in the left-right direction, of the upper surfaces 661 and 662 of the inclined portions 641 and 642 contact with the wiper support portion 32, the area of sections, of the wiper support portion 32, that contact with the inclined portions 641 and 642 can be reduced. Therefore, the pressure of contact with the wiper support portion 32 can be increased. Consequently, it becomes difficult for the wiper support portion 32 to be unsteady with respect to the inclined portions 641 and 642. The area of the sections, of the wiper support portion 32, that contact with the inclined portions 641 and 642, is small. Therefore, it is possible to reduce the possibility that the ink is attached between the wiper support portion 32 and the inclined portions 641 and 642. It is also possible to reduce the possibility that the wiper support portion 32 and the inclined portions 641 and 642 are fixed to each other. Therefore, the wiper 31 can operate correctly and thus it is possible to reduce the possibility that the ink remains on the nozzle surface 111. It is therefore possible to reduce the possibility that the ink remaining on the nozzle surface 111 is fixed. It is also possible to reduce the possibility that it becomes difficult to eject ink from the nozzle surface 111. All of the first contact protrusion portions 671 and 672 (refer to FIG. 5) and the second contact protrusion portions 911 (refer to FIG. 14) need not necessarily be provided.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A printer comprising:

a head portion including a nozzle surface, the nozzle surface including a nozzle configured to eject liquid, the nozzle surface extending in a first direction and an orthogonal direction, the orthogonal direction being a direction orthogonal to the first direction, and the head portion being configured to move in the orthogonal direction;

a wiper configured to contact with the nozzle surface, a first side of the wiper being configured to be opposed to the nozzle surface;

a wiper support portion supporting the wiper, a first side of the wiper support portion being provided on a second side of the wiper, and the second side of the wiper being an opposite side to the first side of the wiper;

an urging portion configured to urge the wiper in a second direction, the second direction being a direction from the wiper toward the wiper support portion, and the second direction being orthogonal to the nozzle surface;

a first protrusion portion provided on the wiper support portion;

an inclined portion configured to move in the orthogonal direction, the inclined portion being positioned on a second side of the wiper support portion, the second side of the wiper support portion being an opposite side to the first side of the wiper support portion in the second direction, the inclined portion being inclined in the second direction with respect to the orthogonal direction, the inclined portion being configured to move the wiper between a contact position and a separated position in accordance with movement of the inclined portion, the wiper being configured to contact with the nozzle surface in the contact position, the wiper being configured to be separated from the nozzle surface in the separated position, the inclined portion being provided with an opening portion on an end portion on a side, of the inclined portion, toward the second direction;

an engagement portion provided on the inclined portion, the engagement portion extending along the inclined portion, the engagement portion being configured to engage with the first protrusion portion, the first protrusion portion being configured to slide with respect to the engagement portion when the wiper is moved between the contact position and the separated position, and the first protrusion portion being configured to be attached to and detached from the engagement portion via the opening portion; and a guide wall portion configured to guide the movement of the wiper between the contact position and the separated position.

2. The printer according to claim 1, further comprising:

a pair of arm portions provided on both end portions, in the first direction, of the wiper support portion, the pair of the arm portions extending in the second direction;

wherein a pair of the first protrusion portions are respectively provided on the pair of arm portions, the pair of the first protrusion portions protruding toward an inside of the pair of arm portions in the first direction, a pair of the inclined portions are opposed to each other in the first direction, and a pair of the engagement portions are recessed portions provided in side surfaces, in the first direction, of the pair of the inclined portions.

3. The printer according to claim 2, further comprising:

an extension portion extending between end portions on the side, of the pair of the inclined portions, toward the second direction, the extension portion extending in the first direction, and the extension portion having flexibility; and a second protrusion portion protruding from an end portion, in the first direction, of the extension portion, wherein the pair of the inclined portions have flexibility, and the pair of the inclined portions are respectively configured to deflect toward an inside of the pair of the inclined portions when the extension portion deflects.

4. The printer according to claim 1, further comprising:

a third protrusion portion provided on the inclined portion, the third protrusion portion protruding in a direction opposite to the second direction, and the third protrusion portion being configured to contact with the wiper support portion.

5. The printer according to claim 1, further comprising:

a fourth protrusion portion provided on the second side of the wiper support portion, the fourth protrusion portion protruding in the second direction, and the fourth protrusion portion being configured to contact with the inclined portion.

6. The printer according to claim 1, further comprising:

a first wall portion extending in the first direction and the orthogonal direction, the first wall portion being coupled with the inclined portion;

a first hole provided in the first wall portion, the first hole extending in a direction orthogonal to a movement direction of the inclined portion;

a second wall portion provided on an opposite side to the nozzle surface with respect to the first wall portion, the second wall portion extending in the first direction and the orthogonal direction, and the second wall portion being configured to rotate;

a third wall portion provided on an opposite side to the nozzle surface with respect to the second wall portion, the third wall portion extending in the first direction and the orthogonal direction;

a second hole provided in the third wall portion;

a drive shaft inserted through the second hole, the drive shaft being connected to the second wall portion, and the drive shaft being configured to rotate the second wall portion;

a shaft portion inserted through the first hole, the shaft portion being connected to the second wall portion, and the shaft portion being provided on an outside of a center of rotation of the drive shaft;

a fourth wall portion extending in the second direction from a periphery of the second wall portion;

a fifth wall portion connected to the third wall portion, the fifth wall portion being provided on an inside of the fourth wall portion in the first direction and the orthogonal direction, and the fifth wall portion extending in a direction opposite to the second direction along the fourth wall portion;

an inclined surface connected to the third wall portion, the inclined surface being inclined in the second direction with respect to the first direction and the orthogonal direction; and a sixth wall portion connected to an end portion on a side, of the inclined surface, toward the second direction, the sixth wall portion forming a discharge opening configured to discharge the liquid.

7. The printer according to claim 1, further comprising:

a pair of first support portions provided on the wiper support portion, the pair of first support portions being separated from each other in the first direction, and the pair of first support portions supporting the urging portion; and a second support portion provided on an opposite side to the nozzle surface with respect the wiper support portion, the second support portion being provided between the pair of first support portions in the first direction, and the second support portion supporting the urging portion, wherein the urging portion is a coil spring, the pair of first support portions support both end portions of the coil spring, and the second support portion supports a central portion of the coil spring.

* * * * *